US008699739B2

(12) United States Patent
Matsui

(10) Patent No.: US 8,699,739 B2
(45) Date of Patent: Apr. 15, 2014

(54) BOUNDARY MICROPHONE

(75) Inventor: Noriko Matsui, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 907 days.

(21) Appl. No.: 12/839,729

(22) Filed: Jul. 20, 2010

(65) Prior Publication Data

US 2011/0019857 A1 Jan. 27, 2011

(30) Foreign Application Priority Data

Jul. 22, 2009 (JP) ..... 2009-171270

(51) Int. Cl.
*H04R 9/08* (2006.01)

(52) U.S. Cl.
USPC ..... 381/355; 381/91; 381/26; 381/122; 379/433.03

(58) Field of Classification Search
CPC ..... H04R 1/406; H04R 5/027; H04R 1/083; H04R 1/00; H04R 3/005; H04R 2201/025; H04M 2203/509; H04M 2203/50; H04M 1/6033
USPC ..... 381/26, 91, 122, 355, 361, 366, 368, 381/87, 356, 357, 358; 379/433.02, 433.03, 379/436, 440
See application file for complete search history.

(56) References Cited

U.S. PATENT DOCUMENTS

| | | | | |
|---|---|---|---|---|
| 5,121,426 | A | 6/1992 | Baumhauer et al. | |
| 6,158,902 | A * | 12/2000 | Staat | 381/357 |
| 6,560,344 | B1 * | 5/2003 | Julstrom et al. | 381/356 |
| 2006/0239477 | A1 * | 10/2006 | Oxford et al. | 381/150 |
| 2009/0097674 | A1 * | 4/2009 | Watson et al. | 381/86 |
| 2009/0190775 | A1 * | 7/2009 | Reining | 381/92 |

FOREIGN PATENT DOCUMENTS

| | | | |
|---|---|---|---|
| JP | 59-117899 | A | 7/1984 |
| JP | 03-293846 | A | 12/1991 |
| JP | 2005-229433 | A | 8/2005 |
| JP | 2007-019693 | A | 1/2007 |
| JP | 2008-288933 | A | 11/2008 |
| JP | 2009-100157 | | 5/2009 |

* cited by examiner

*Primary Examiner* — Vivian Chin
*Assistant Examiner* — Con P Tran
(74) *Attorney, Agent, or Firm* — Whitman Curtis Christofferson & Cook, PC

(57) ABSTRACT

A boundary microphone includes: a base made of metal; a cover that is made of metal and has a plurality of holes through which a sound wave is guided; a microphone unit that converts sound into an electric signal; and a microphone unit holder slidably provided on the base and holds the microphone unit. The microphone unit holder has a knob. The base has a hole through which the knob of the microphone unit holder penetrates the base. The knob of the microphone unit holder and the hole of the base are so provided that the microphone unit holder can be moved with the microphone unit by a movement of the knob within a range defined by the hole.

11 Claims, 13 Drawing Sheets

BOUNDARY MICROPHONE

BACKGROUND OF THE INVENTION

1. Field of the Invention

The present invention relates to a boundary microphone that is mainly placed on a table upon use, and more specifically to a boundary microphone having a unit with which a sound pickup direction can be easily changed.

2. Description of the Related Art

Boundary microphones are known that are mainly placed on a table upon use. FIG. 11 illustrates an example of a conventional boundary microphone. A base 27 of the boundary microphone illustrated in FIG. 11 is formed of a flat piece of metal and can be fixed on a surface of a desk or a floor. In an upper surface of the base 27, a cavity (dimple) for mounting a circuit board 28 and the like is formed. From the upper surface of the base 27, a column 21 integrally formed with the base 27 is erected, approximately in the center when viewing the base 27 from the plane direction. A later described cover 20 is connected to the base 27 via the column 21. In the column 21, a tapped hole 22 is formed from the upper end. For the base 27, the left side and the right side in FIG. 11 are the front side and the backside, respectively, and a wall is integrally formed at the back end of the base 27. A bush 24 is fitted into a hole that is formed through this wall. In the case of a boundary microphone installed in a conference room, the boundary microphone is installed on a table or the like with the front side facing the participants. One end of a microphone cord 25 is passed through a center hole of the bush 24. The microphone cord 25 is generally a cord constituted of a two-core balanced output cord and a shielding wire wrapping around the two-core balanced output cord. The end portions of the above-described two-core signal cable and shielding wire constituting the microphone cord 25 are connected to a predetermined soldering land or the like on the later-described circuit board 28.

In the upper surface of the base 27, the circuit board 28 is secured to the approximately front half portion of the above-described cavity so as to plug the cavity. In the upper surface of the circuit board 28, a microphone unit 26 is mounted with the sound wave introducing port thereof facing forward. As the microphone unit 26, a capacitor microphone unit is generally used. The cover 20 for covering the whole upper surface of the base 27 including the microphone unit 26 and the circuit board 28 is put on the base 27. The cover 20 is made of a metallic material, as in the case of the base 27, and numerous openings for introducing sound waves to the microphone unit 26 are formed therein. As the material of the cover 20, generally, a punching metal is used, in which numerous holes are formed by punching. The cover 20 is press molded into a flat plate form which is then inverted and put on the upper surface of the base 27. In the cover 20, approximately in the center when viewing the cover 20 from the plane direction, a dimple is formed at a position corresponding to the column 21 of the base 27 and a hole is formed in the bottom of this dimple. A screw 23 as a fastening member is inserted into this hole, and the screw 23 is screwed into the tapped hole 22 formed in the column 21, so that the cover 20 is fastened to the base 27. The head of the screw 23 sinks into the inside of the dimple of the cover 20. A receiving portion for the peripheral portion of the cover 20 is formed in the periphery of the upper surface side of the base 27, and the receiving portion is designed so that the peripheral portion of the cover 20 can be in contact with the base 27 while the cover 20 is fastened to the base 27 with the screw 23 as described above.

As described above, the boundary microphone includes mainly two parts, i.e., the base 27 and the cover 20 in appearance, and the internal components are incorporated in the internal space (see, for example, an invention disclosed in Japanese Patent Application Publication 2009-100157). The screw 23 inserted in the hole of the cover 20 is screwed into the tapped hole 22 of the base 27, and whereby the base 27 and the cover 20 are mutually fastened. The base 27 and the cover 20 are fastened together with one screw 23 approximately in the center of the cover 20 and the head of the screw 23 fits into the dimple of the cover 20.

A conventional boundary microphone having a circular shape as illustrated in FIGS. 12 and 13 is available. In FIGS. 12 and 13, the circular boundary microphone mainly includes: a base 117 having a circular planer shape; a cover 120 having a shape of a lid with a circular planer shape; microphone units 116 installed on the base 117 and covered with the cover 120; a cord insertion hole 125 provided at a center position of the base 117 as viewed from the plane direction, through which an internal space covered by the cover 120 is communicated with the outside; an external connection cord 123 inserted through the cord insertion hole 125; a rubber plate 122 provided under the base 117; and a tubular shaft 124 fitted in the cord insertion hole 125.

The cord insertion hole 125 is formed on the base 117. The internal space covered by the cover 120 is communicated with the outside through the cord insertion hole 125. The cord insertion hole 125 is formed at the intersection point of the central axis lines of the three microphone units 116 that are radially arranged. The base 117 is made of a flat piece of metal and the rubber plate 122 provided thereunder serves as a supporting base therefor. The cover 120 is pressed by a pressing material 121 in the inner diameter direction thereof. An insertion hole for a screw 113 is provided at the center of the cover 120 as viewed from the plane direction. The cover 120 is fixed to the base 117 with the screw 113 being screwed into a tapped hole appropriately provided on the tubular shaft 124 through the insertion hole. A circuit board not illustrated is provided on the upper surface of the base 117.

The above described boundary microphone includes mainly three parts, i.e., the base 117, the cover 120, and the pressing material 121 in appearance, and the internal components are incorporated in the internal space. The boundary microphone needs to be adjusted to have desired sound pickup direction upon use. More specifically, installation direction of a microphone unit 116 incorporated in a boundary microphone is changed by opening the cover 120 and manually dismounting the microphone units 116, moving the microphone units 116 to the desired directions, and fixing the microphone units 116 thereat.

The above described process takes time and has to be performed by a skilled person to prevent failure inside the boundary microphone. Thus, maintenance cost is required. A person with certain knowledge may perform the maintenance. However, in such a case, the resistance against external noise may not be ensured after the maintenance because the maintenance involves processing on internal structure that is related to radio-frequency interference (RFI) resistance.

SUMMARY OF THE INVENTION

An object of the present invention is to provide a boundary microphone that anyone can easily move a microphone unit therein without causing a failure inside the boundary microphone to easily obtain desired sound pickup direction so that the process for obtaining the desired sound pickup direction is abbreviated to reduce the maintenance cost.

A boundary microphone according to an aspect of the present invention includes: a base made of metal; a cover that is made of metal and has a plurality of holes through which a sound wave is guided; a microphone unit that converts sound into an electric signal; and a microphone unit holder slidably provided on the base and which holds the microphone unit. The microphone unit holder has a knob. The base has a hole through which the knob of the microphone unit holder penetrates the base. The knob of the microphone unit holder and the hole of the base form a microphone unit position changing unit with which the microphone unit holder is able to move with the microphone unit by a movement of the knob within a range defined by the hole.

Any one can easily adjust the boundary microphone according to the present invention from outside with the microphone unit position changing unit. The user can easily adjust the boundary microphone to have an appropriate sound pickup direction without breaking the components inside the boundary microphone because the adjustment can be performed from outside. Thus, adjustment may not necessarily be performed by a skilled person and thus the maintenance cost can be saved.

DETAILED DESCRIPTION OF THE PREFERRED EMBODIMENTS

An embodiment of a boundary microphone according to the present invention is described below with reference to some of the accompanying drawings.

Figure 1:
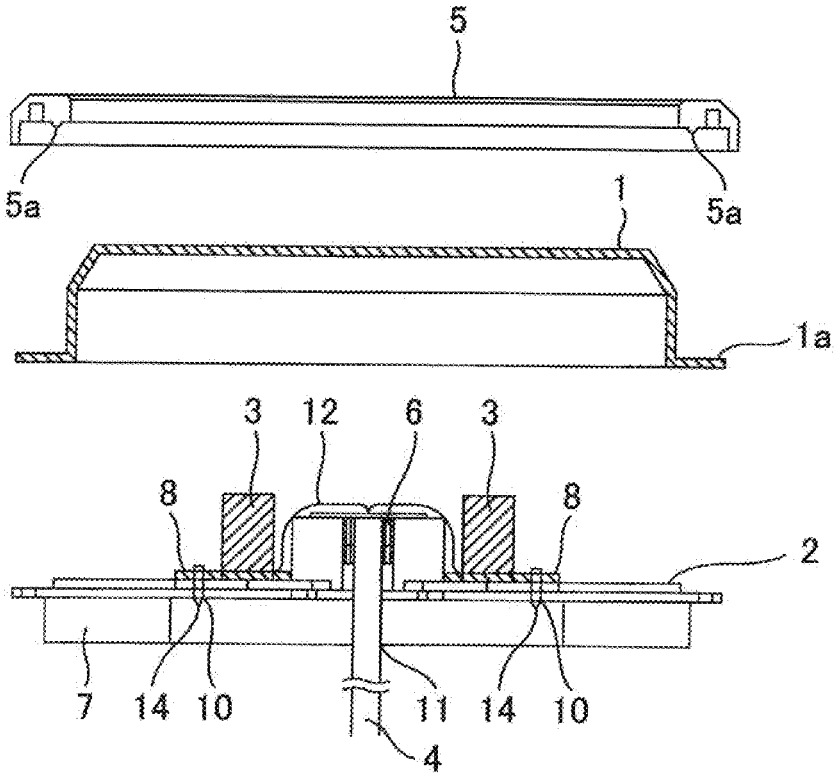
FIG. 1 is an exploded cross-sectional view of an embodiment of a boundary microphone according to the present invention.
Figure 2:
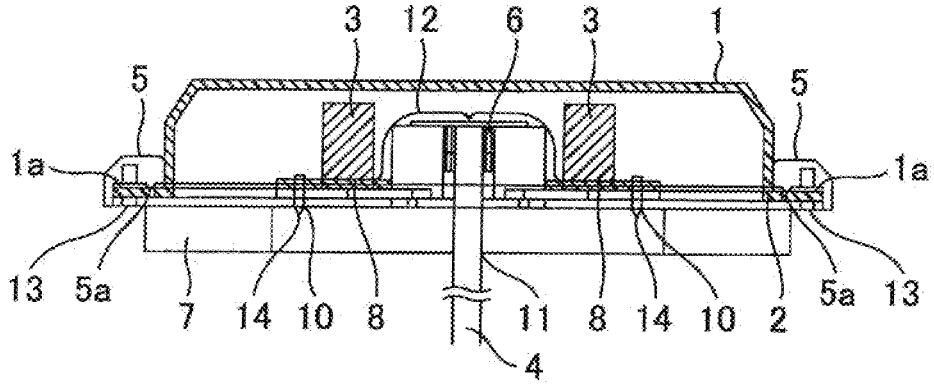
FIG. 2 is a cross-sectional view of the embodiment.
Figure 3:
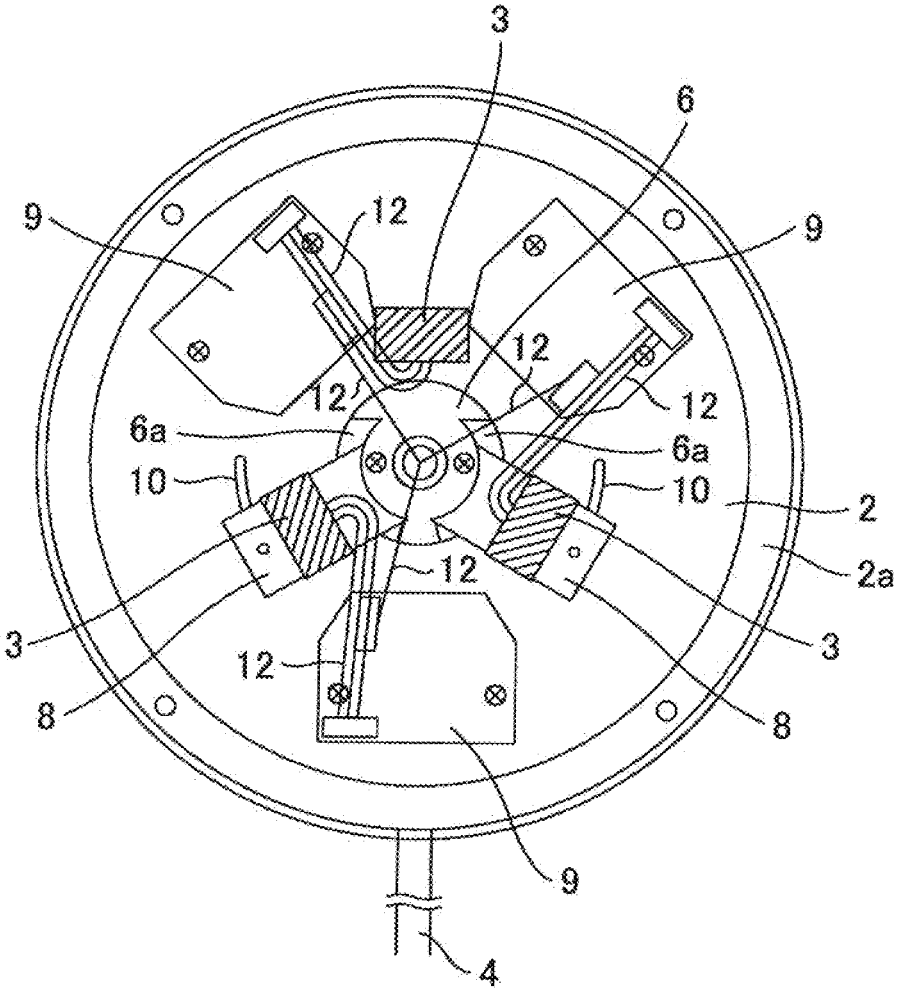
FIG. 3 is a top view of the embodiment with a cover removed.

In FIGS. 1 to 3, a boundary microphone according to the present embodiment has a shape of a flat circular dish and mainly includes: a cover 1 having a flat flange portion 1*a* at the periphery on its opening end; a base 2 having a circular planar shape; a pressing material 5 having a shape of a ring; three microphone units 3; two microphone unit holders 8 each holding one of the microphone units 3 and being slidably installed on the base 2; knobs 14 each provided under the microphone unit holders 8; a circuit hoard 9 illustrated in FIG. 3; two holes 10 formed on the base 2, through which knobs 14 of the microphone unit holders 8 penetrate the base 2; a cord insertion hole 11 provided at a center position of the base 2 as viewed from the plane direction, through which the internal space covered by the cover 1 communicates with the outside; a pedestal 7 provided under the base 2; a tubular shaft 6 fitted in the cord insertion hole 11; a connection cord 4 for connecting with outside, inserted in the tubular shaft 6; and a wiring 12.

As illustrated in FIG. 2, the pressing material 5 having a shape of a ring presses the flange portion 1*a* of the cover 1 at the entire circumference thereof. The pressing member 5 has a protruding portion 5*a* at the bottom surface, i.e., the surface facing the flange portion 1*a* of the cover 1. The protruding portion 5*a* presses the flange portion 1*a*. The flange portion 1*a* of the cover 1 is pressed against the base 2 with the protruding portion 5*a*. The protruding portion 5*a* is continuously formed at the entire periphery of the pressing material 5. The base 2, the cover 1, and the pressing material 5 are integrally fastened with fastening members 13, e.g., screws.

In the boundary microphone configured as described above, the base 2 made of metal and the cover 1 are in surface connection and no gaps are produced at the peripheral portion. Further, with the pressing material 5 pressing the cover 1, the flange portion 1*a* of the cover 1 can be rigidly fixed on the upper surface of the base 2 at the peripheral portion. With the protruding portion 5*a*, the pressing force of the pressing material 5 is concentrated on the flange portion 1*a* of the cover 1. Thus, the flange portion 1*a* of the cover 1 can be more rigidly fixed on the upper surface of the base 2 at the peripheral portion through surface connection without producing any gaps. Thus, electromagnetic waves which enter the internal components from the outside can be more effectively blocked. Thus, the shielding effect is further improved and the occurrence of noise due to electromagnetic waves can be prevented. In addition, the manufacturing cost can be reduced because a shielding material is not required to be incorporated.

As illustrated in FIG. 2, the tubular shaft 6 having a tubular shape is fitted in the cord insertion hole 11 of the base 2. The connection cord 4 for connecting with the outside is inserted in the tubular shaft 6. As illustrated in FIG. 3, the three microphone units 3 are provided around the tubular shaft 6 with their sound collecting surface facing outward in the radial direction of the base 2. Two of the three microphone units 3 are held by the respective microphone unit holders 8. The microphone unit holders 8 are so installed to be able to slide along a circular surface 6*a* formed on the tubular shaft 6 around the cord insertion hole 11, and move on a surface or the base 2 in an arc. Therefore, the two microphone units 3 held by the respective microphone unit holders 8 can also move in an arc around the cord insertion hole 11 together with the microphone unit holders 8 for a certain angular range. The remaining one microphone 3 is fixed on the base 2. The casing of each of the two microphone units is electrically connected the base 2 via the microphone unit holder 8. The casing of the remaining microphone unit 3 is electrically connected to the base 2 directly, i.e., not via the microphone unit holder 8. Each of the microphone unit holders 8 slides while being in contact with the circular surface 6*a* of the tubular shaft 6. Thus, the microphone units 3 can move with their casing electrically connected to the base 2.

In the above described embodiment, the cord 4 is passed through the tubular shaft 6 towards the downward direction of the base 2. Thus, the cord 4 is not in the sound pickup range of the microphone units 3. Accordingly, sounds from a surrounding area can be efficiently picked up. The sliding mechanism of the microphone unit 3 is not limited to that illustrated and can be of any appropriate type. For example, a member for facilitating the sliding movement can be used.

The three microphone units 3 are so provided that the center axis lines thereof run parallel to the surface of the base 2. In an exemplary positioning, the two movable microphone units 3 are radially arranged around the cord insertion hole 11 with an angular interval of 120 degrees. The two microphone unit holders 8 hold the respective microphone units 3 with the angular interval therebetween maintained. As illustrated in FIGS. 1 and 2, the knobs 14 are integrally provided with the respective microphone unit holders 8 at the bottom surfaces thereof. The knobs 14 are integrally provided with the microphone unit holders 8 by an appropriate technique such as integral molding or by bonding. The two holes 10 through which the knobs 14 of the microphone unit holders 8 pass through are formed on the base 2. The movement of the microphone unit holders 8 around the cord insertion hole 11 is guided along the holes 10. The holes 10 are each formed in an arc around the cord insertion hole 11, and in a certain range so that the moving range of the microphone unit holders 8 is restricted.

Figure 4:
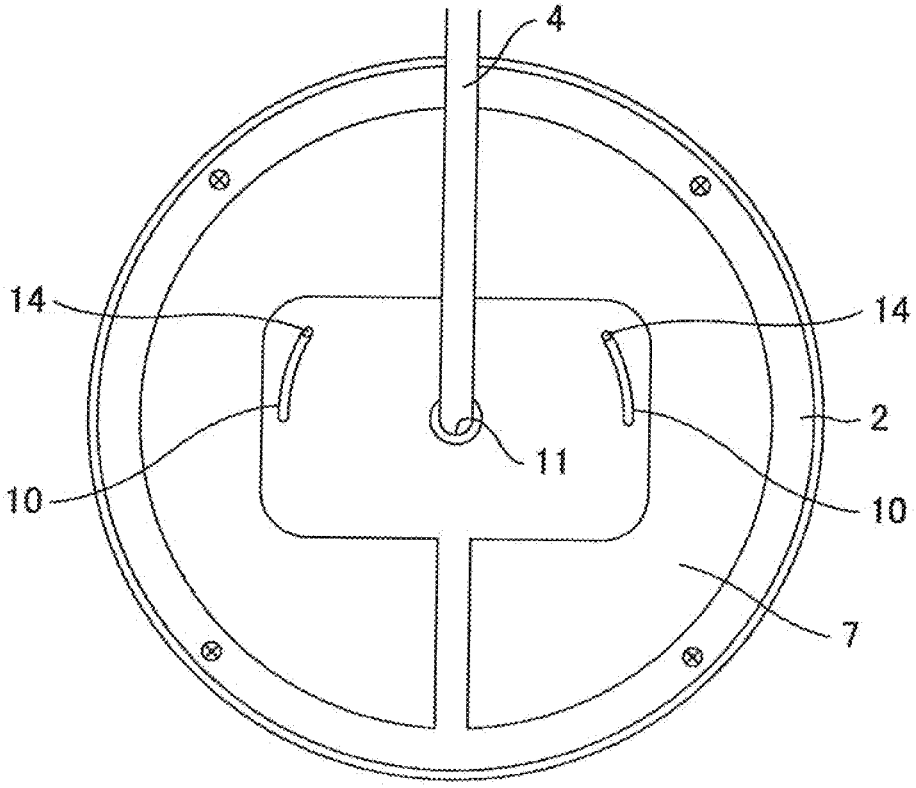
FIG. 4 is a bottom view of the embodiment.

As illustrated in FIG. 4, the holes 10 are each formed as a slit in a shape of an arc around the cord insertion hole 11. The microphone units 3 can move together with the microphone unit holder 8 as the knobs 14 move at the bottom surface of the base 2 in the range defined by the holes 10. Thus, the hole 10, the microphone unit holder 8, and the knob 14 configure a microphone unit position changing unit.

The numbers of microphone unit 3 and the microphone unit holder 8, i.e., the number of microphone unit position changing unit in the boundary microphone according to the present invention can be arbitrarily set. For example, all three microphone units 3 can be radially arranged on the base 2 while being held by the respective microphone unit holders 8, and only one microphone unit 3 or all three microphone units 3 may be provided with the position changing unit. The number of holes 10 is set in accordance with the number of the microphone unit position changing unit. The knob 14 can be integrally molded with the microphone unit holder 8 or may be fixed thereon by means of, for example, adhesion.

Figure 5:
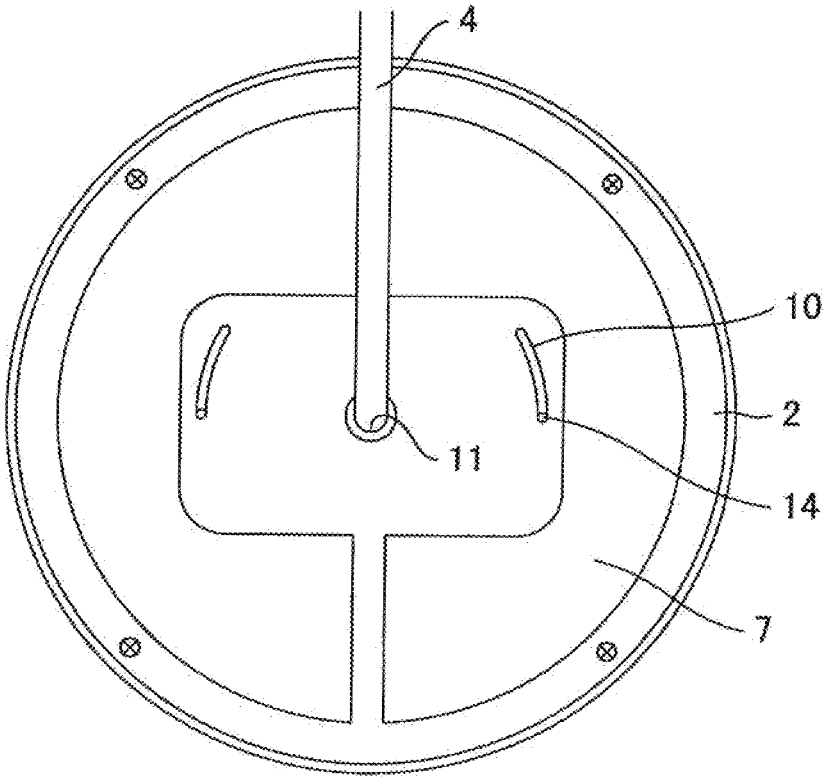
FIG. 5 is a bottom view of the embodiment in another operating state.
Figure 6:
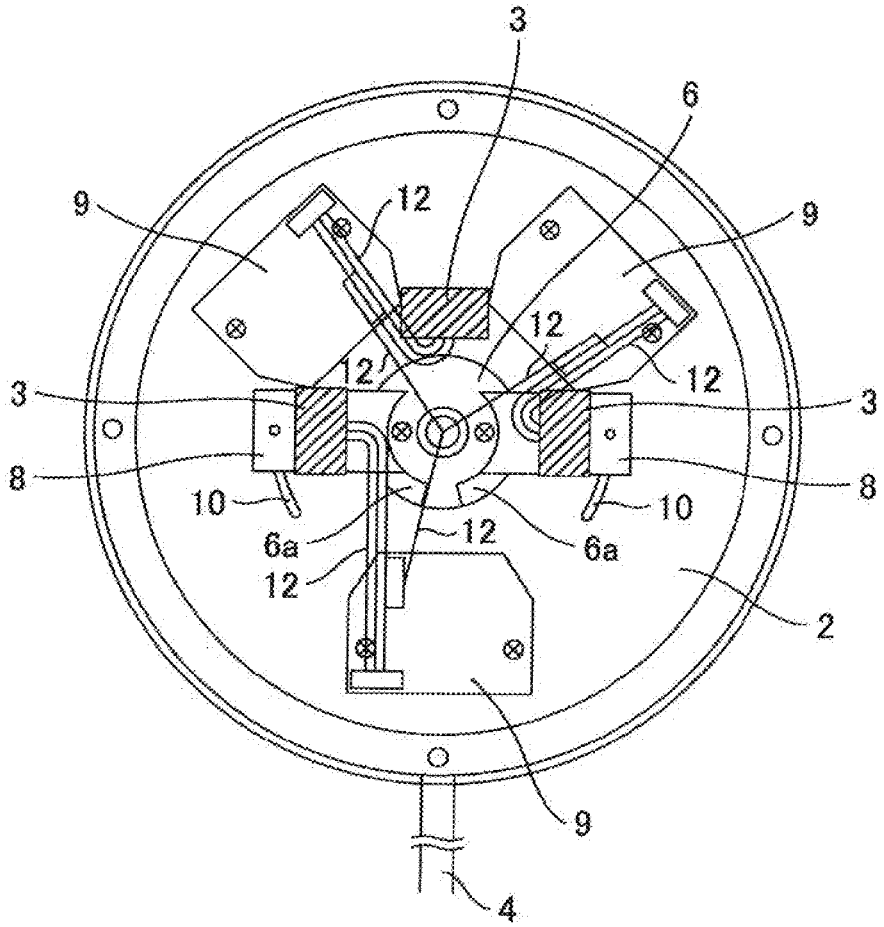
FIG. 6 is a top view of the embodiment in the operating state as illustrated in FIG. 5, illustrated in accordance with FIG. 3.

The three microphone units 3 are provided in a circumferential direction with angular intervals of 120 degrees as illustrated in FIG. 3 with the two knobs 14 each being positioned at an end of the hole 10 provided on the base 2. More specifically, the knob 14 on the right side in FIG. 4 is positioned at the movement limit position in the counter clockwise direction around the cord insertion hole 11, while the knob 14 on the left side in FIG. 4 is positioned at the movement limit position in the clockwise direction around the cord insertion hole 11. The two microphone units 3 held by the two respective microphone unit holders 8 are provided with the angular interval of 180 degrees in the circumferential direction as illustrated in FIG. 6 with the knobs 14 each being positioned at the other end of the hole 10 of the base 2 as illustrated in FIG. 5. That is, the microphone unit position changing units are so set that the center axis lines of the two microphone units 3 form a straight line. It is to be noted that, if two microphone units 3 each held by the respective microphone unit position changing units are positioned with an angular interval of 180 degrees, the remaining microphone unit 3 is so positioned that the center axial line thereof is perpendicular to the straight line connecting the centers of the two microphone units 3.

The number of the circuit boards 9 provided on the base 2 is as same as that of the microphone units 3. The circuit boards 9 are each fixed at a position between the microphone units 3. The microphone units 3, the circuit boards 9, and the cord 4 are electrically connected via the appropriate wiring 12 so as to be able to be in connection with an external output and so that power can be supplied thereto. In the boundary microphone having above described structure, the range in which the sound can be collected can be easily adjusted by operating the knob 14 composing the microphone unit position changing unit. The circuit boards 9 and the wirings 12 can be disposed at any positions as long as the movement of the microphone unit holder 8 is not interfered. For example, if three microphone units 3 are disposed as in the illustrated embodiment, preferably, three circuit boards 9 are radially provided around the cord insertion hole 11.

Figure 7:
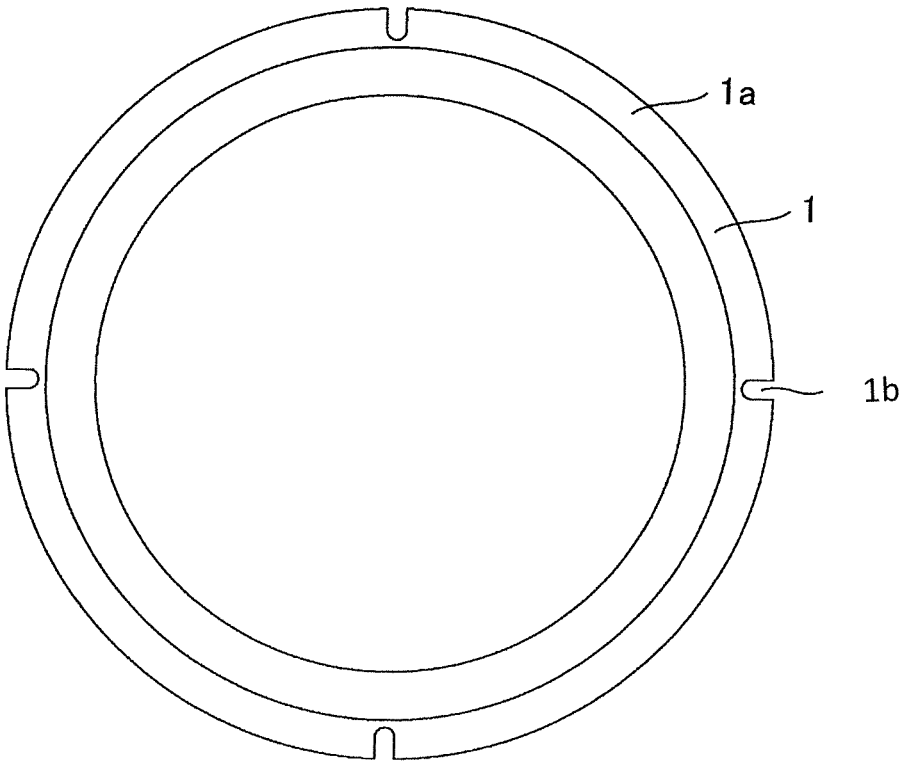
FIG. 7 is a top view illustrating the cover in the embodiment.

As described above, the cover 1 covers the upper surface of the base 2 including the microphone units 3 and the circuit boards 9. The cover 1 is made of metal like the base 2. Numerous holes through which the sound wave is introduced to the microphone unit 3 are formed on the cover 1. A punching metal on which numerous holes are formed thereon by punching is used as the cover 1 to cover the upper surface of the base 2 in an inverted state. As illustrated in FIG. 7, notches 1*b* through which the fastening members 13 pass are provided on a plurality of portions on the flange portions 1*a* of the cover 1. As illustrated in FIG. 3, a receiving portion 2*a* for the flange 1*a* of the cover 1 is formed in the periphery of the upper surface of the base 2 having a circular planar shape. Thus, the contact between the peripheral portion of the cover 1 and the base 2 is facilitated. The material and the shape of the cover 2 are not limited to those described above. The shape and the material can be arbitrarily set as long as numerous openings through which sound waves are guided to the microphone unit are formed thereon as shown in FIG. 3.

As described above; the flange 1*a* of the cover 1 is formed on the entire outer periphery of the cover 1. The surface of the cover 1 is coated except for the surface to be in contact with the base 2, i.e., the bottom surface of the cover 1. Therefore, the cover 1 and the base 2 are electrically connected with each other. The non-coated surface may be formed by not performing coating thereon in the coating process or by removing the coating thereon after the entire surface of the cover 1 is coated. The planar shape of the cover 1 and the base 2 is not limited to circular and can be rectangular or triangular.

The pressing material 5 having a shape of a ring presses the flange portion 1*a* of the cover 1 at the entire circumference. As illustrated in FIG. 1, the pressing member 5 has a protruding portion 5*a* that presses the flange portion 1*a* at the surface facing the flange portion 1*a* of the cover 1. The protruding portion 5*a* is formed on the entire outer periphery of the pressing member 5 and has a semicircle cross-sectional shape. The cross-sectional shape of the protruding section 5*a* can be arbitrarily selected. The protruding section 5*a* may be formed on the entire outer periphery of the pressing member 5 or may be serially formed on the outer periphery thereof. In terms of pressing effect, the protruding portion 5*a* is preferably formed on the entire periphery so that the pressure is applied on the entire circumference. The base 2, the cover 1, and the pressing material 5 are integrally fastened by the appropriate fastening members 13. In a boundary microphone, a capacitor microphone unit with an impedance converter is generally used as the microphone unit 3. A tone control circuit, a sound output circuit, and the impedance converter, all of which is not illustrated, are installed on the circuit board 9.

Figure 8:
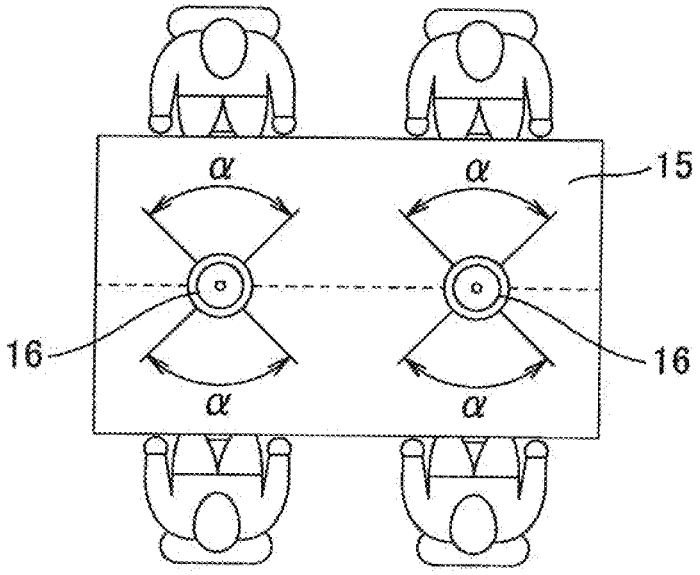
FIG. 8 is a top view schematically illustrating the embodiment in a used state.

As illustrated in FIG. 6, in the case where the two microphone units 3 are held by the respective microphone unit holders 8 are positioned with the angular interval of 180 degrees, the direction the remaining one microphone unit 3 faces is perpendicular to the line connecting the centers of the two microphone units 3. FIG. 8 depicts a state in which boundary microphones 16 with the remaining one microphone unit 3 not held by the microphone unit holder 8 turned off are placed on a table. Here, only the two microphone units 3 positioned in back to back manner with the angular interval of 180 degrees perform electro-acoustic conversion. The boundary microphones 16 can pick up sound waves in sound pickup angle range of $\alpha$ degrees on both front and back thereof, where $\alpha$ degree is the sound pickup angle range of the microphone units 3. All things considered, the boundary microphone 16 with the above setting may be placed at a center portion of a table 13 in the front-back direction in the case where the participants are seated across the table 5 on the front and back sides.

Figure 9:
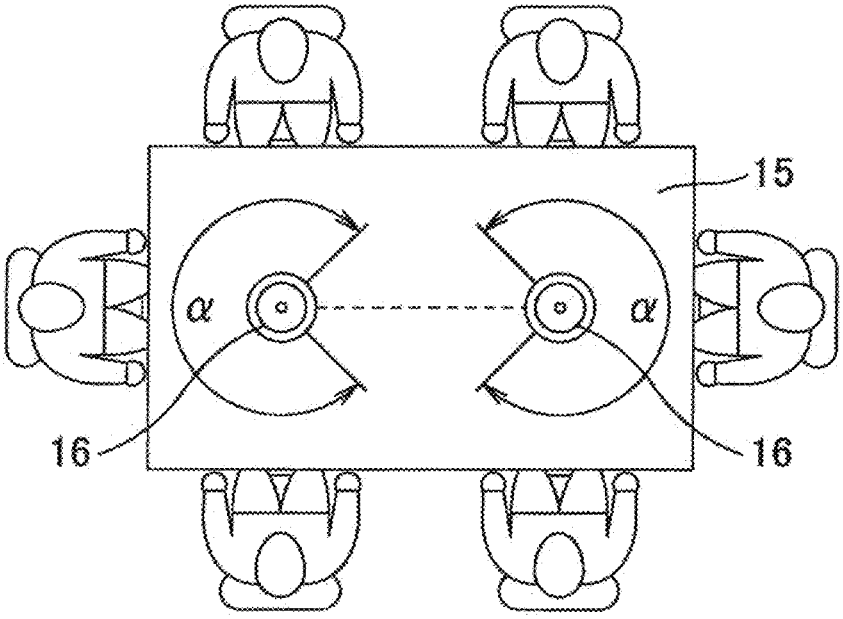
FIG. 9 is a top view schematically illustrating the embodiment in another used state.

FIG. 9 depicts a state in which the two microphone units 3 held by the two respective microphone unit holders 8 are positioned to have angular interval of 180 degrees in the circumferential direction, and all three microphone units 3 including the remaining one microphone unit 3 are turned on. The two microphone units 3 having angular interval of 180 degrees and the remaining one microphone unit 3 facing the direction perpendicular to the center axis lines of the two microphone units 3 each has a sound pickup range. Therefore, in a conference where the participants are seated around the table 15, the boundary microphone 16 with the above setting can pickup voices from participants seated on front and back sides and on the lateral side by being placed on an end portion of the table 15.

Figure 10:
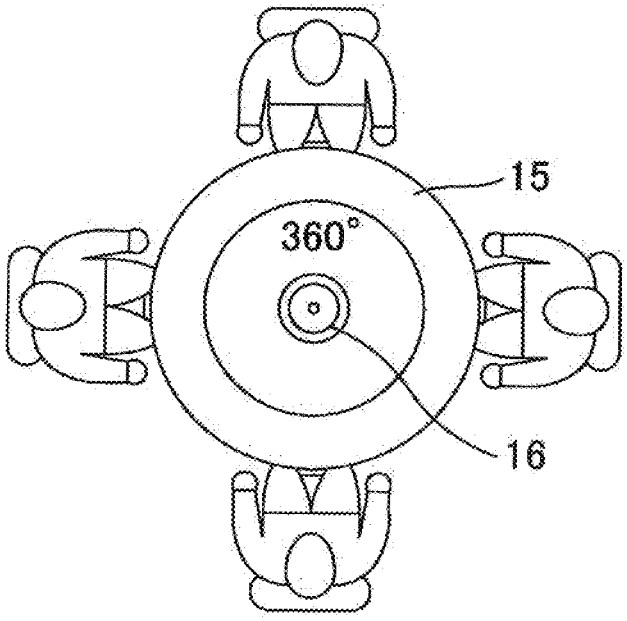
FIG. 10 is a top view schematically illustrating the embodiment in still another used state.
Figure 11:
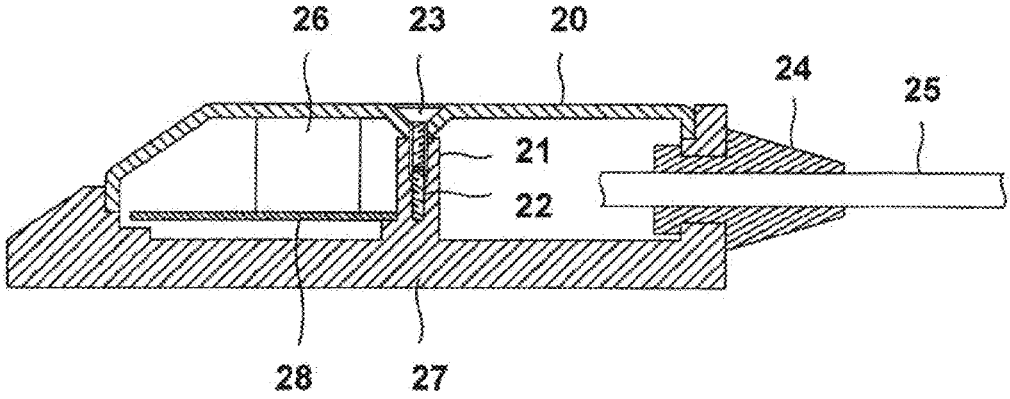
RELATED ART FIG. 11
FIG. 11 is a cross-sectional view of a conventional boundary microphone.
Figure 12:
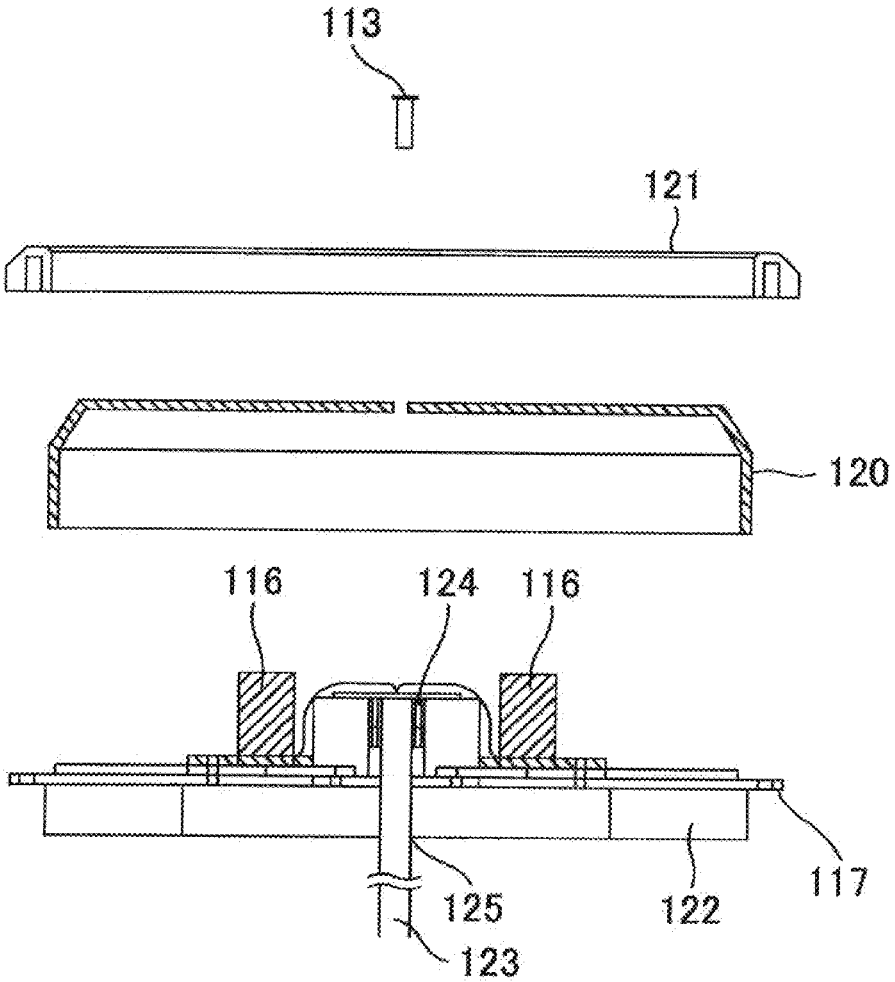
RELATED ART FIG. 12
FIG. 12 is an exploded cross-sectional view of a conventional circular boundary microphone.
Figure 13:
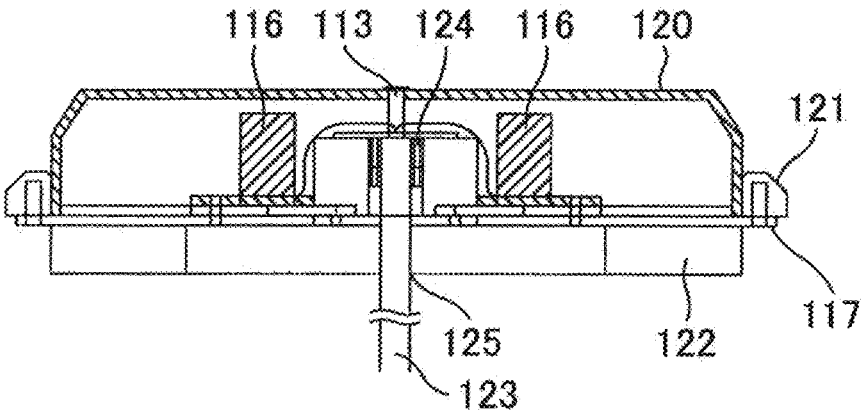
RELATED ART FIG. 13
FIG. 13 is a cross-sectional view of the conventional boundary microphone.

With the three microphone units 3 radially disposed at angular intervals of 120 degrees around the cord insertion hole 11, the sound pickup can be performed on the entire circumferential direction, i.e., 360 degrees in the planer direction as illustrated in FIG. 10. Thus, voices of all the participants seated around this table 15 in FIG. 10 can be picked up.

Anyone can easily adjust the sound pickup range from the outside of the boundary microphone 16 with the microphone unit position changing unit. If the cover 1 has to be removed to adjust the sound collecting range, the adjustment may lead to the breaking of internal components, for example, by accidentally touching the internal components. According to the illustrated embodiment, the user can easily adjust the boundary microphone to have an appropriate sound pickup direction without breaking the components inside the boundary microphone because the adjustment can be performed from the outside. Thus, no skilled person is required for the adjustment and thereby the maintenance cost can be saved.

The boundary microphone according to the present invention is not limited to the above structure. The microphone unit 3 inside the cover 1 and the base 2 of the boundary microphone can be covered with a shielding member such as a metallic mesh. Further, an appropriate speaker unit can be added to the internal configuration to form a boundary microphone with attached speaker that can solely serve as both sound pickup device and speaker. The boundary microphone with attached speaker may be, for example, placed on a table of a conference room and the like upon use.

What is claimed is:

1. A boundary microphone comprising:

a base made of metal;

a cover that is made of metal and has a plurality of holes through which a sound wave is guided;

a plurality of microphone units each of which converts sound into an electric signal; and a plurality of microphone unit holders slidably provided on the base, each of which holds a microphone unit of the plurality of microphone units, wherein each of the microphone unit holders has a knob, the base has a plurality of slot shaped through holes wherein a knob of a microphone unit holder penetrates the base through a through hole of said plurality of through holes, and each knob and each through hole for each microphone unit holder form a microphone unit position changing unit with which the respective microphone unit holder is movable with the microphone unit by a movement of the knob within a range defined by the through hole, and wherein the microphone units are radially arranged on the base, the microphone units are disposed at equal angular intervals in the circumferential direction of the base when the microphone unit holders are each positioned at a first end of a corresponding through hole, and the microphone units are disposed at non-equal angular intervals in the circumferential direction of the base when the microphone unit holders are each positioned at a second end of the corresponding through hole.

2. The boundary microphone according to claim 1, wherein the base has a cord insertion hole through which an internal space covered by the cover and an outside are communicated, and the cord insertion hole is provided at an intersection point of center axis lines of the radially-arranged plurality of microphone units.

3. The boundary microphone according to claim 2, wherein a tubular shaft is fitted in the cord insertion hole, a cord is inserted in the tubular shaft, and wherein said plurality of microphone unit holders includes two microphone unit holders and said two microphone unit holders are slidably provided around the tubular shaft.

4. The boundary microphone according to claim 1, wherein planar shapes of the cover and the base are circular.

5. The boundary microphone according to claim 1, wherein said plurality of microphone units includes three microphone units, said plurality of microphone unit holders includes two microphone unit holders, wherein each of said two microphone unit holders holds one of said three microphone units, said three microphone units are disposed at 120 degree angular intervals as said equal angular intervals in said circumferential direction of said base when said two microphone unit holders are each positioned at said first end of the corresponding through hole, and said two microphone units held by said two microphone unit holders are disposed at 180 degree angular intervals as said non-equal angular intervals in said circumferential direction of said base when said two microphone unit holders are each positioned at said second end of the corresponding through hole.

6. The boundary microphone according to claim 5, wherein the base has a cord insertion hole through which an internal space covered by the cover and an outside are communicated, and the cord insertion hole is provided at an intersection point of center axis lines of the radially-arranged three microphone units.

7. The boundary microphone according to claim 6, wherein a tubular shaft is fitted in the cord insertion hole, a cord is inserted in the tubular shaft, and said two microphone unit holders are slidably provided around the tubular shaft.

8. The boundary microphone according to claim 5, wherein, in the case where the two microphone unit holders have said non-equal angular interval of 180 degrees in the circumferential direction, a remaining one microphone unit faces a direction perpendicular to a line connecting centers of the microphone units held by said two microphone unit holders.

9. The boundary microphone according to claim 8, wherein the base has a cord insertion hole through which an internal space covered by the cover and an outside are communicated, and the cord insertion hole is provided at an intersection point of center axis lines of the radially-arranged three microphone units.

10. The boundary microphone according to claim 9, wherein a tubular shaft is fitted in the cord insertion hole, a cord is inserted in the tubular shaft, and the two microphone unit holders are slidably provided around the tubular shaft.

11. The boundary microphone according to claim 1 wherein each of said plurality of microphone units is held by one of said plurality of microphone unit holders.

* * * * *